US008864194B2

(12) United States Patent
Gledhill et al.

(10) Patent No.: US 8,864,194 B2
(45) **Date of Patent: *Oct. 21, 2014**

(54) ADJUSTABLE STRIKE

(71) Applicant: Assa Abloy New Zealand Limited, Albany (NZ)

(72) Inventors: Steven A. Gledhill, Taupo (NZ); Shelly Ellen Farrell, Cobh (IE)

(73) Assignee: Assa Abloy New Zealand Limited, Albany (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,261

(22) Filed: Oct. 7, 2013

(65) Prior Publication Data

US 2014/0033502 A1 Feb. 6, 2014

Related U.S. Application Data

(60) Division of application No. 12/568,784, filed on Sep. 29, 2009, now Pat. No. 8,579,340, which is a continuation-in-part of application No. 11/901,641, filed on Sep. 17, 2007, now Pat. No. 8,007,017.

(51) Int. Cl.
*E05B 15/02* (2006.01)
*E05B 17/00* (2006.01)
*E05B 65/08* (2006.01)

(52) U.S. Cl.
CPC ..... *E05B 17/0004* (2013.01); *E05B 15/0245* (2013.01); *E05B 65/0858* (2013.01); *E05B 15/0255* (2013.01); *E05B 15/024* (2013.01)
USPC ..... 292/341.19

(58) Field of Classification Search
CPC .. E05B 85/045; E05B 15/024; E05B 65/0007
USPC ..... 292/340, 341.18, 341.19, DIG. 60; 49/394, 395, 463, 503
See application file for complete search history.

(56) References Cited

U.S. PATENT DOCUMENTS

| | | | | | |
|---|---|---|---|---|---|
| 1,214,227 | A | * | 1/1917 | Schwenk | 292/341.19 |
| 3,257,139 | A | | 6/1966 | Russell et al. | |
| 3,361,466 | A | | 1/1968 | Russell et al. | |
| 3,416,828 | A | | 12/1968 | Russell et al. | |
| 3,506,293 | A | | 4/1970 | Armstrong et al. | |
| 3,774,345 | A | | 11/1973 | Cole et al. | |
| 3,860,276 | A | * | 1/1975 | Lambrecht | 292/169 |
| 3,966,248 | A | * | 6/1976 | James | 292/340 |
| 4,082,332 | A | * | 4/1978 | Palmer | 292/259 R |
| 4,105,235 | A | * | 8/1978 | Thiel | 292/341.18 |
| 4,183,568 | A | * | 1/1980 | Ferracane | 292/341.18 |
| 4,189,175 | A | * | 2/1980 | Paxton | 292/340 |
| 4,288,120 | A | * | 9/1981 | Moore | 292/341.18 |
| 4,305,611 | A | * | 12/1981 | Robins | 292/238 |
| 4,395,892 | A | * | 8/1983 | Remington | 70/312 |

(Continued)

*Primary Examiner* — Kristina Fulton
*Assistant Examiner* — Nathan Cumar
(74) *Attorney, Agent, or Firm* — DeLio, Peterson & Curcio, LLC

(57) ABSTRACT

The invention relates to an adjustable strike having a striker plate, an end cap removably attached to an end of the striker plate, and the end cap having a first protrusion and a second protrusion, each for attaching the end cap with a door frame. The end cap also has a tab for removably attaching the striker plate with the end cap. The invention also relates to a method of providing the adjustable strike.

20 Claims, 13 Drawing Sheets

(56) References Cited

U.S. PATENT DOCUMENTS 4,432,575 A * 2/1984 Garvey et al. ..... 292/341.18
4,453,752 A 6/1984 McKann
4,492,397 A * 1/1985 Allenbaugh ..... 292/341.18
4,614,068 A 9/1986 Bergthold
5,328,217 A * 7/1994 Sanders ..... 292/341.19
5,660,420 A * 8/1997 Smith et al. ..... 292/3
6,491,326 B1 12/2002 Massey et al.

* cited by examiner

ADJUSTABLE STRIKE

CROSS REFERENCED TO RELATED APPLICATION

This is a divisional application, which claims priority to U.S. patent application Ser. No. 12/568,784 filed Sep. 29, 2009 which is a continuation-in-part application that claims priority to and the benefit of U.S. Pat. No. 8,007,017 filed Sep. 17, 2007, entitled "Striker Plate, a Door Jamb Assembly and a Method of Securing a Striker Plate to a Door Surround Structure," which is incorporated herein by reference in its entirety.

FIELD OF INVENTION

The invention relates to an adjustable strike for a door.

BACKGROUND OF THE INVENTION

In order to lock a door, a bolt of the lock will generally engage with a strike mounted in a door frame. If the strike is not aligned with the bolt, it may negatively affect the ability to lock the door, including difficulty in using the lock or requiring a user to exert a tremendous amount of energy to lock the door. In other situations, an improperly aligned strike may cause the lock to prematurely fail. In the event the improperly positioned strike causes an installer to remove and reinstall the striker plate, such reinstallation could leave unwanted holes or other damage in the door frame.

To alleviate this alignment problem, some strikes are adjustable, where they may be repositioned to align with the bolt in an easier manner than traditional strikes. Conventionally, this is achieved through slotted screw holes, which allows the strike to be positioned approximately and then finally adjusted to a correct position. Usually, the initial approximate positioning requires the installer to hold the strike in position whilst marking the door frame or drilling the fixing holes.

However, the slots typically provide a limited amount of adjustment and, if further adjustment is needed, the installer may need to remove and reinstall the strike, which leaves the unwanted holes and/or damage to the door frame. Additionally, performing the multiple tasks of marking the door frame, drilling holes, and positioning the striker simultaneously may contribute to an improper initial approximate position. As a result, it is not uncommon for the installer to place the strike so far out of position that the adjustment provided is insufficient to enable the strike to be set in a correct position.

What is desired, therefore, is a strike that has improved adjustment capabilities. Another desire is a strike that may be adjusted and secured in a final position with reduced damage to the door frame.

SUMMARY OF THE INVENTION

It is therefore an object of the invention to provide an adjustable strike that permits repeated adjustments within a door frame.

Another object is an adjustable strike that permits repeated adjustments without using requiring fasteners.

A further object is an adjustable strike that includes a plurality of striker plates, each interchangeable with one another.

The above and other objects, which will be apparent to those skilled in the art, are achieved in the present invention which is directed to an adjustable strike having a striker plate, an end cap removably attached to an end of the striker plate, and the end cap having a first protrusion and a second protrusion, each for attaching the end cap with a door frame. The end cap also has a tab for removably attaching the striker plate with the end cap.

In some embodiments, the striker plate has a receiver for engaging with the tab of the end cap.

In other embodiments, the first and second protrusions are made of a resilient material for flexing into the door frame and providing an interference fit. In some of these embodiments, the first and second protrusions extend in generally opposing directions and outwardly away from a center of the end cap for engaging with the door frame.

In another embodiment, the striker plate has at least one hole through which a fastener passes.

In a further embodiment, the end cap and the striker plate each having a top surface, wherein the top surface of the end cap is higher relative to the top surface of the striker plate.

In an optional embodiment, each of the first and second protrusions includes at least one finger located at an end of each of the first and second protrusions for engaging with the door frame.

In some embodiments, the end cap includes a notch between the first protrusion and a center of the end cap for allowing the first protrusion to flex toward the center when engaging with the door frame.

In another aspect of the invention, an adjustable strike includes a first striker plate and a second striker plate, a first end cap and a second end cap, where each of the end caps has a first protrusion and a second protrusion, where each of the protrusions is for attaching the end cap with a door frame. The invention also has the first and second striker plates each being removably attachable between the first and second end caps, and each of the end caps also have a tab for removably attaching with either the first striker plate or the second striker plate.

In another aspect of the invention, a method for providing an adjustable strike comprises the steps of providing an end cap and a striker plate, extending a first protrusion away from a center of the end cap, and extending a second protrusion away from the center of the end cap in a generally opposing direction from the first protrusion. The method also places a tab on the end cap, places a receiver on the striker plate, and removably attaches the end cap and striker plate together by engaging the tab of the end cap with the receiver of the striker plate.

In an optional embodiment, the method also comprises the step of securing the end cap and striker plate within a door frame without using a fastener. In some of these embodiments, the method includes the step of adjusting the end cap and striker plate within the door frame without using a fastener. In a further embodiment, the method slides the end cap and striker plate within the door frame without fastening or unfastening a fastener.

In another embodiment, the method raises a top surface of the end cap to be higher than a top surface of the striker plate.

BRIEF DESCRIPTION OF THE DRAWINGS

In the following more detailed description of the invention, according to one preferred embodiment, reference will be made to the accompanying drawings in which the striker plate is illustrated in conjunction with a door frame section, the drawings including.

DESCRIPTION OF THE PREFERRED EMBODIMENT(S)

Figure 1:
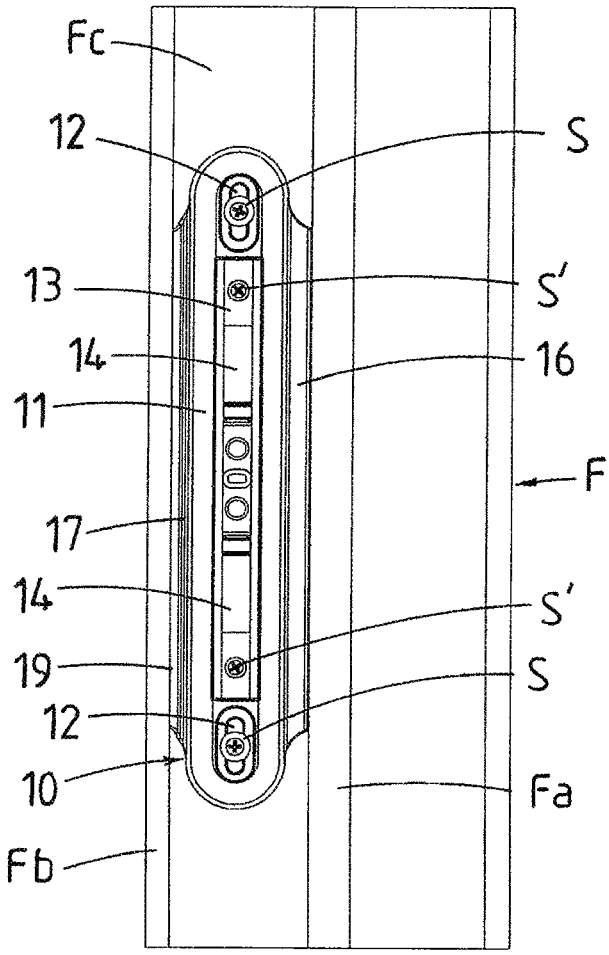
FIG. 1 shows a front view of the striker plate and part of the door frame section.

In describing the preferred embodiment of the present invention, reference will be made herein to FIGS. 1-19 of the drawings in which like numerals refer to like features of the invention.

The striker plate as illustrated and referred to herein is one form that a striker plate may take. Thus, as disclosed, it is in the form of an assembly that includes a body 11 which has at or toward each end means for fixed mounting, namely an elongate mounting slot 12. These slots 12 are aligned and are disposed on a longitudinal axis of the body 11. Screws S can be engaged through the slots to fix the striker plate in a final fixed mounted position.

The body 11, in the illustrated form of striker plate 10, includes a central elongate opening 12. An insert 13 in the body 11 is located adjacent the opening 12. This insert 13 includes one or more openings or apertures 14 with which the bolt(s) of a lock (not shown) can engage.

It will be appreciated by those skilled in the art that a striker plate can take different forms to that described above and illustrated in the drawings. The actual configuration of the body 11, and the manner in which the lock bolt apertures 14 are provided, can vary from manufacturer to manufacturer. Also, different arrangements of elongate slots providing for vertical adjustment of the position of the striker plate 10 can be provided. The arrangement, as illustrated, is therefore by way of example only.

The striker assembly 10 is provided with a first projection 16 from one side of body 11 and a second projection 17 from the other side. These projections 16 and 17 engage with the door surround structure more commonly referred to as a frame F. The projections 16 and 17 thus locate and hold the striker assembly 10 in its lateral position so as to provide a means of positioning the striker assembly 10 accurately in the lateral direction. As well they hold the striker plate 10 in position vertically while the fasteners, such as fixing screws S, are inserted through the elongate slots 12 (or other similar formations).

One or both of the projections 16 and 17 may be biased outwardly. In a preferred form of the invention one or both of the projections 16 and 17 are resilient or exhibit resilience. The projection thus has the effect of being "spring loaded". This spring loading can be achieved by virtue of the form of construction used to form the projection and/or its disposition relative to the body 11. The projection can be coupled to the body 11, or to the insert 13, or in some other manner, formed as a separate component of the overall assembly of the striker plate 10 and be suitably biased relative thereto.

In the illustrated form of the invention, the projections 16 and 17 are formed integrally as a unit part of the body 11. This provides a convenient form of manufacture and keeps down the number of individual components making up the striker assembly 10.

In the illustrated form of the invention projection 16 is essentially flat and projects laterally from the body 10. The distal edge is formed as an upturned edge or tip 18.

In this form of the invention the other projection 17 inclines upwardly and away from the base of the housing 10 and is, therefore, formed so as to have a degree of resilience or springiness i.e. is effectively "spring loaded". This projection 17 terminates at its distal edge in a slightly curved edge portion 19.

Figure 2:
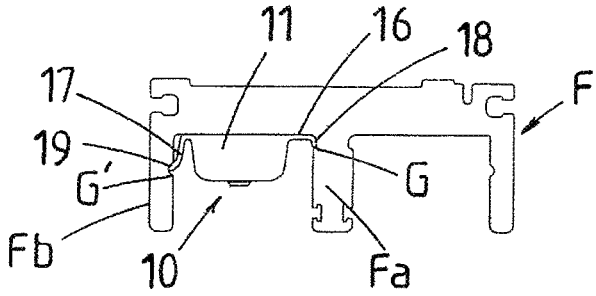
FIG. 2 shows a top plan view of the arrangement shown in FIG. 1.

As can be seen in FIG. 2, the projections 16 and 17 preferably locate in grooves or indentations G and G' in parts Fa and Fb of the door frame F. The upturned edge 18 fits into groove G while the curved distal edge 19 engages in the groove G'.

The spring loading of the projection 17 thus, not only enables the body 11 with projections 16 and 17 to be forced into place between parts Fa and Fb but also has the effect of wedging or holding the body 11 in place in the door frame F. The projections 16 and 17, therefore, hold the strike assembly in a lateral position as well as in an adjusted vertical position. The fixing screws S can thus be inserted to fix the striker assembly 10 in the correction position.

With the striker plate, as illustrated in the drawings, adjustment in the third axis is also possible. The insert 13 is held against screws S' (which mount the insert 13) by springs (not shown). Hence the position of the insert 13 relative to the surface Fc of frame F against which the body 11 is mounted can be adjusted.

It will be appreciated by those skilled in the art that the embodiment, as described herein and illustrated, shows a striker assembly for a sliding door. However, it will be appreciated that the concept can also be applied to a hinged door.

It will be appreciated by those skilled in the art that the striker plate is open to modification. For example, the projections 16 and 17 can take different forms to accommodate different types of door frame sections. Also, while in the preferred embodiment, a single projection 16 and 17 is provided at each longitudinal side of the elongate body 11, this is only one embodiment and a series of individual projections, lugs, flanges or the like could be provided on one or both side of the striker plate assembly 10. Alternatively, the body 10 could be formed to engage a flange of the frame section F and a single (or plurality) of projections be used to engage another flange or part of frame F to wedge the striker plate in place.

Figure 3:
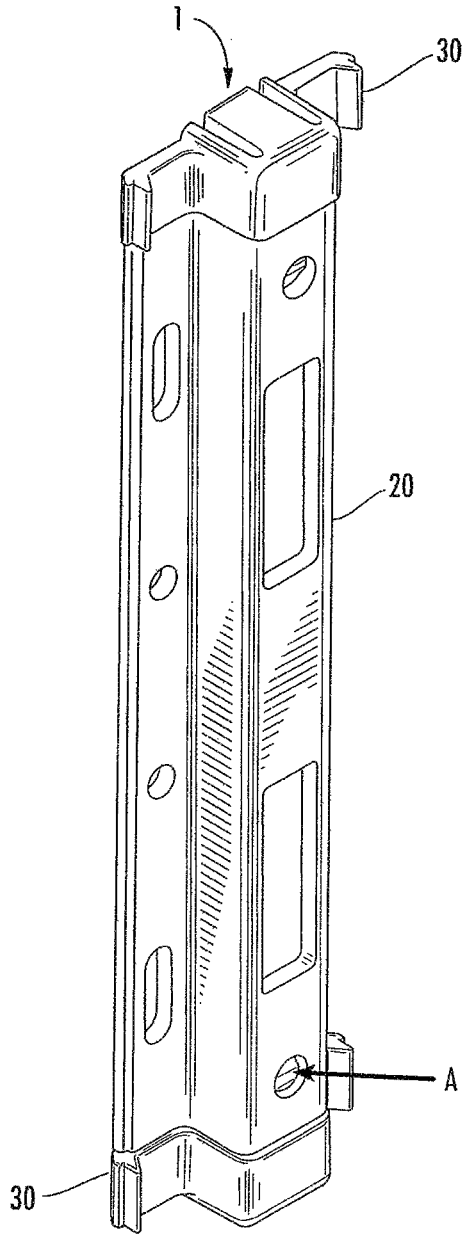
FIG. 3 depicts the adjustable strike in accordance with the invention.
Figure 4:
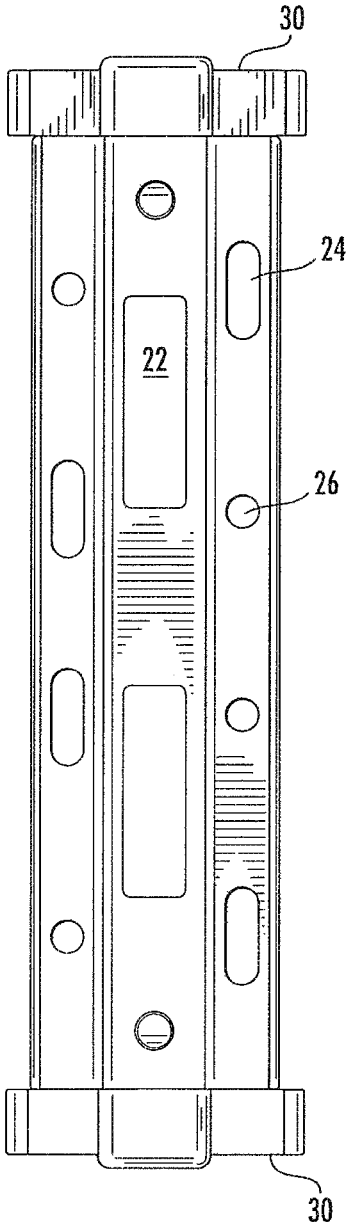
FIG. 4 depicts a front view of the strike shown in FIG. 3.
Figure 5:
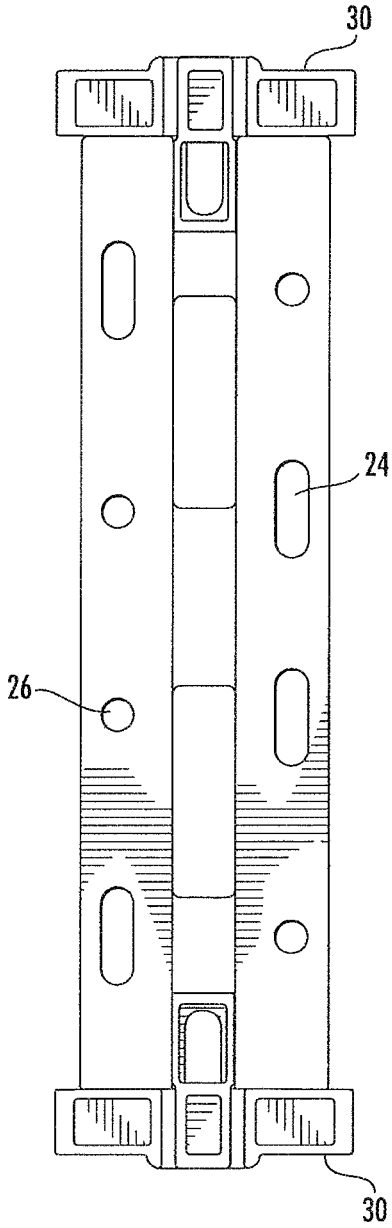
FIG. 5 depicts a rear view of the strike shown in FIG. 3.

FIGS. 3-5 depict strike 1 in accordance with the invention, where strike 1 includes striker plate 20 and at least two end caps 30.

As shown more particularly in FIGS. 7-9 and 11, end cap 30 includes center section 32, first protrusion 36, second protrusion 40, and tab 48 for removably attaching striker plate 20 and end cap 30 together. First protrusion 36 and second protrusion 40 each extend in generally opposing directions away from center section 32 for engaging with door frame 64 (shown in FIG. 11). As shown more particularly in FIG. 10, tab 48 is a flexible extension that is inserted into receiver 52 of striker plate 20, where receiver 52 is an orifice for receiving the flexible extension. End cap 30 and striker plate 20 may be detached from one another by pressing upon tab 48 in the direction A as indicated in FIG. 3, where the flexible extension will flex and disengage from the orifice which allows striker plate 20 to be slidingly disengaged from end cap 30 as shown in FIG. 10.

Because striker plate 20 is removably attached to end cap 30, multiple striker plates may be interchangeable with one another depending upon a physical characteristic of each striker plate. For example, an installer or customer may select a particular striker plate based upon color, size, shape, texture, and the like. See FIGS. 16-18 for various striker plates 20', 20", and 20'" all interchangeable with each other and each removably attachable to the same end cap 30. In other embodiments, the type of lock chosen for the door may influence a choice of or be adaptable to select number of striker plates, in which case having the ability to interchange striker plates is beneficial. In a further embodiment, the installer may choose a striker plate to correct errors in installation, in which case the striker plate may have a height that is taller or shorter from other striker plates.

Figure 14:
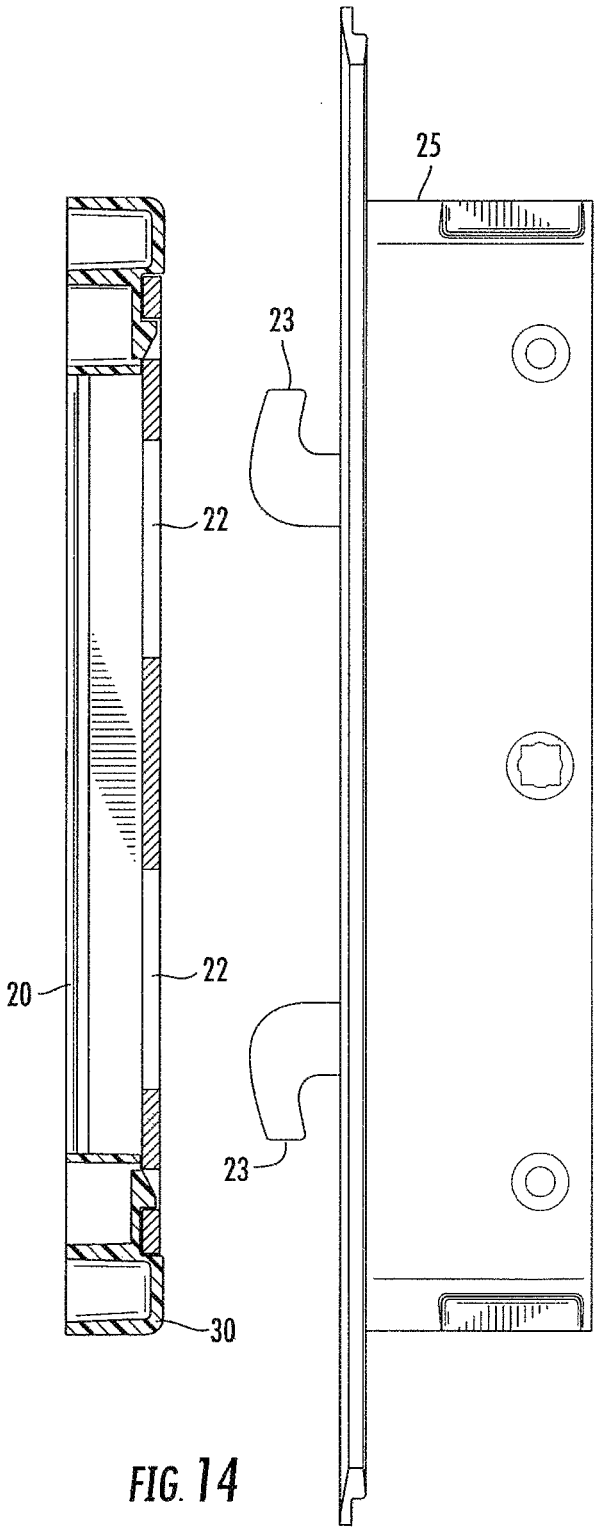
FIG. 14 depicts a cross sectional view of the strike shown in FIG. 3 and a side view of a lock.
Figure 15:
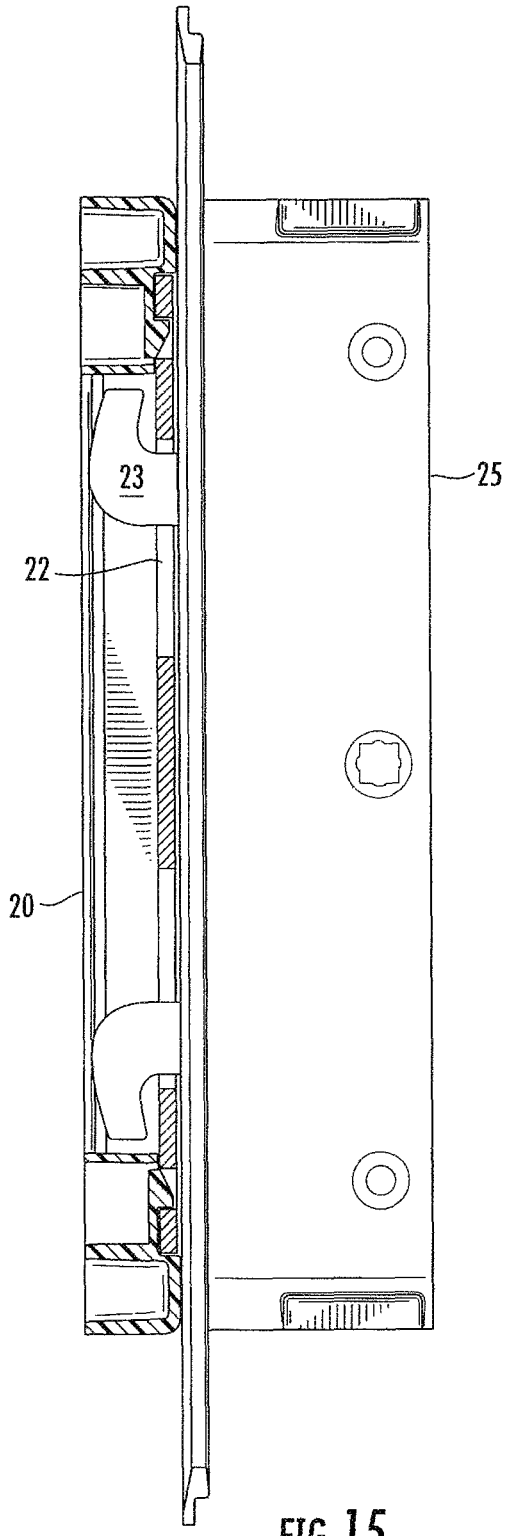
FIG. 15 depicts a side view of the strike shown in FIG. 3 engaged with a lock.
Figure 16:
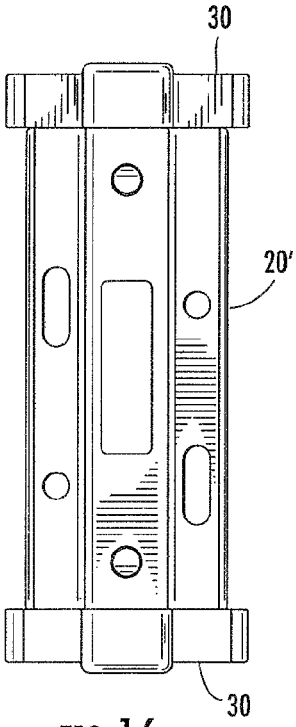
FIGS. 16-18 depict front views of various embodiments of the strike shown in FIG. 3.
Figure 17:
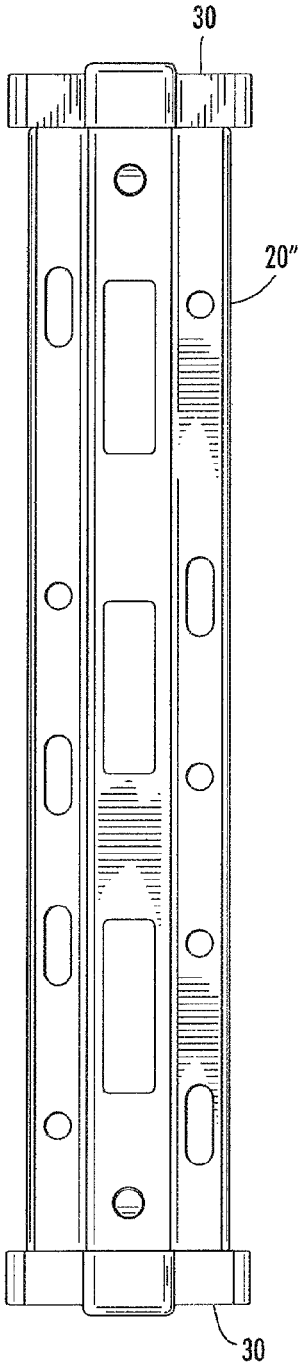
Figure 18:
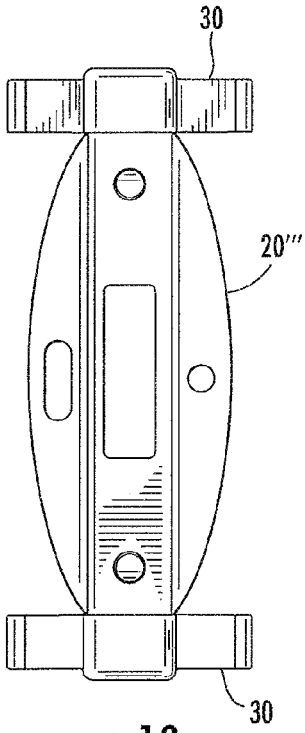

As shown in FIGS. 4 and 14-15, striker plate 20 includes bolt hole 22 for receiving bolt 23 from lock 25, resulting in a locked door. Striker plate 20 also includes slotted fastener hole 24 and round hole 26, each for receiving a fastener for attaching strike 1 to the door frame in a permanent manner after all adjustments to strike 1 are completed.

Figure 11:
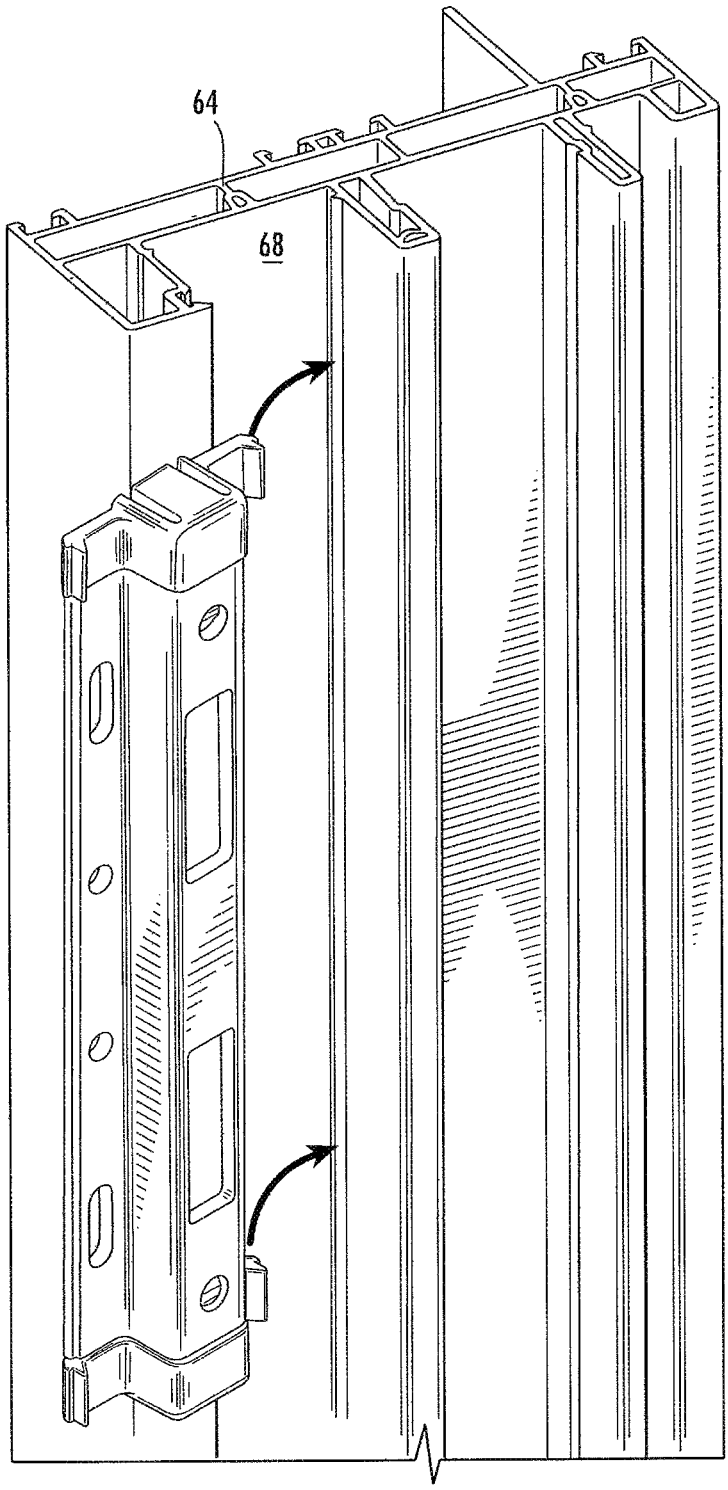
FIGS. 11-12 depict perspective views of the strike shown in FIG. 3 and a door frame.
Figure 12:
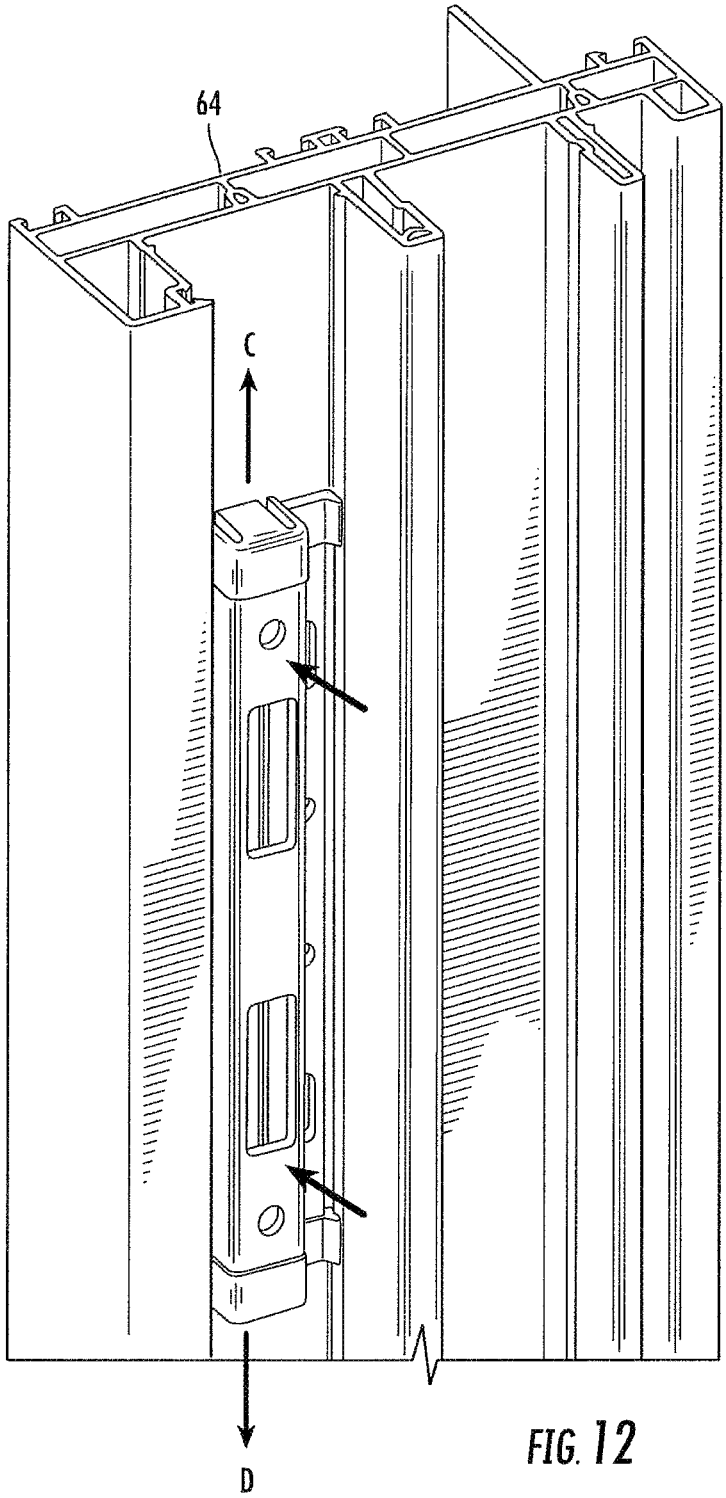
Figure 13:
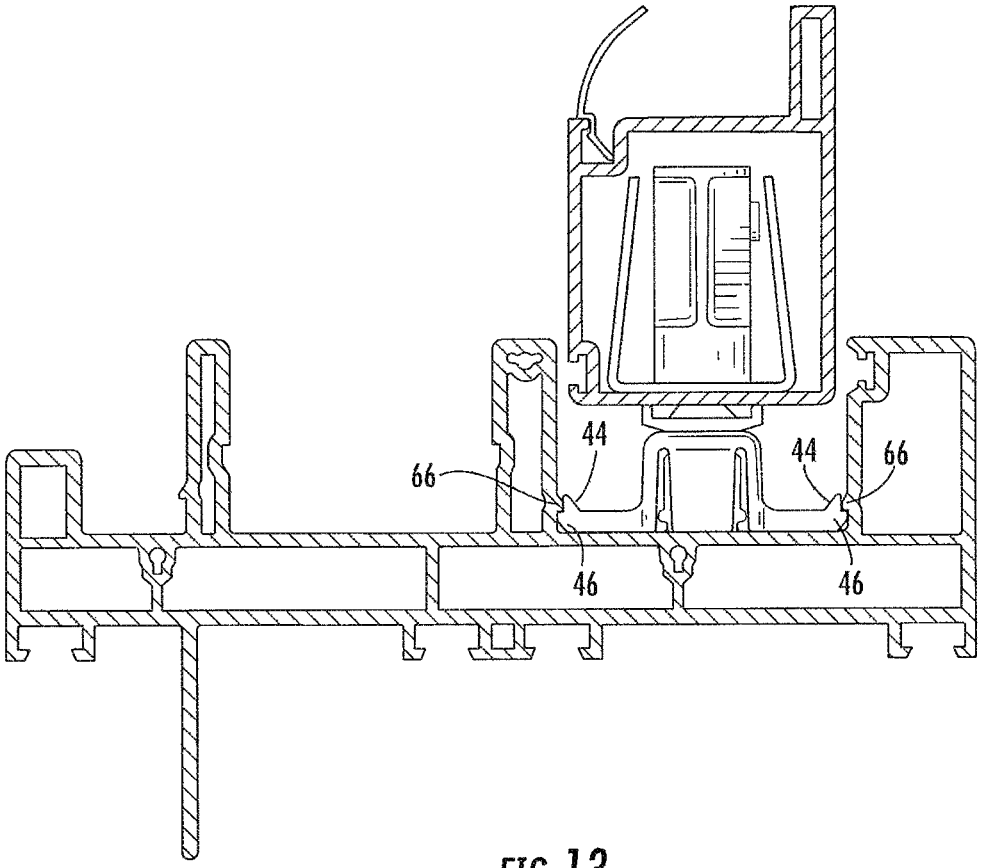
FIG. 13 depicts a cross sectional view of the strike shown in FIG. 3 and the door frame shown in FIGS. 11-12.

In reference to FIGS. 11-13, when attached to door frame 64, end cap 30 holds itself and striker plate 20 as an assembly when pushed into ridge 66 by an installer. The installer installs fasteners into slotted hole 24 and/or round hole 26 after striker plate 20 is determined to be in a final position. It is understood the invention does not require fasteners for end cap 30 to hold striker plate 20 within door frame 64. However, in some embodiments, the installer chooses to permanently affix striker plate 20 and prevent inadvertent adjustment or movement of striker plate 20 after determining the final position.

When pushed or snapped into door frame 64 (FIGS. 12-13), upper finger 44 is compressed toward center section 32 by ridge 66 and therefore upper finger 44 has an interference or snug fit with ridge 66, where the upper finger 44 is compressed against ridge 66. In addition, lower finger 46 fits under ridge 66 and is therefore inhibited from separating from door frame 64 by ridge 66. Upper and lower fingers 44, 46 together hold end cap 30 and striker plate 20 within door frame 64.

In some embodiments, provided upper and lower fingers 44, 46 maintain the relationship with ridge 66 as shown in FIG. 13, the installer may repeatedly adjust end cap 30 and striker plate 20 in sliding directions shown by arrows C and D in FIG. 12 within door frame 64. Because of the interference fit with upper finger 44 and because lower finger 46 is held behind ridge 66, the friction between ridge 66 and upper and lower fingers 44, 46 allow the repeated adjustments without fastening and unfastening any fasteners.

In fact, no fasteners are needed before or after snapping in end cap 30 and striker plate 20 and no fasteners are needed before or after repeated adjustments in directions C or D.

Figure 7:
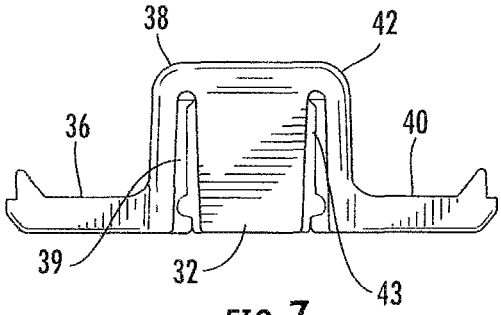
FIG. 7 depicts a rear view of the end cap shown in FIG. 3.
Figure 8:
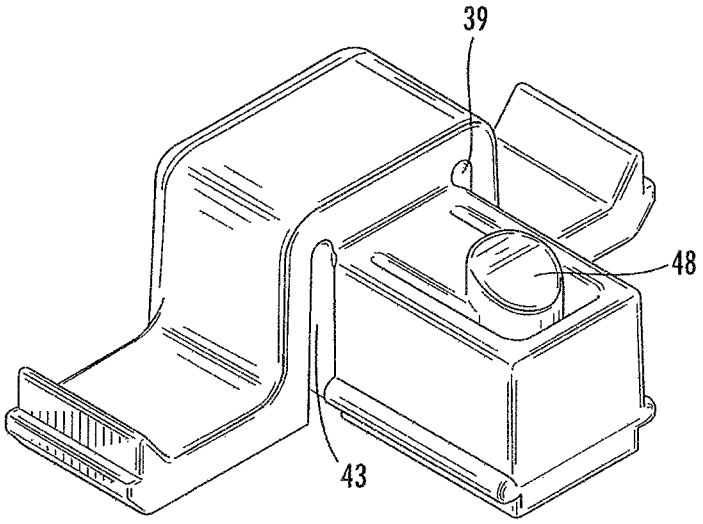
FIG. 8 depicts a front perspective view of the end cap shown in FIG. 3.
Figure 9:
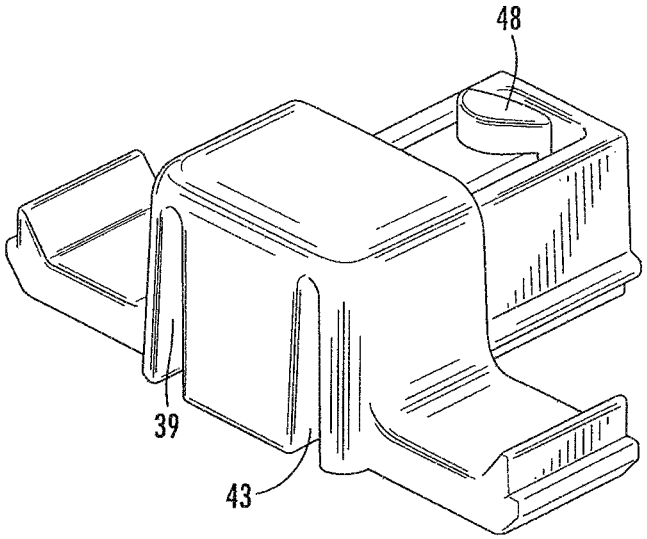
FIG. 9 depicts a rear perspective view of the end cap shown in FIG. 3.
Figure 10:
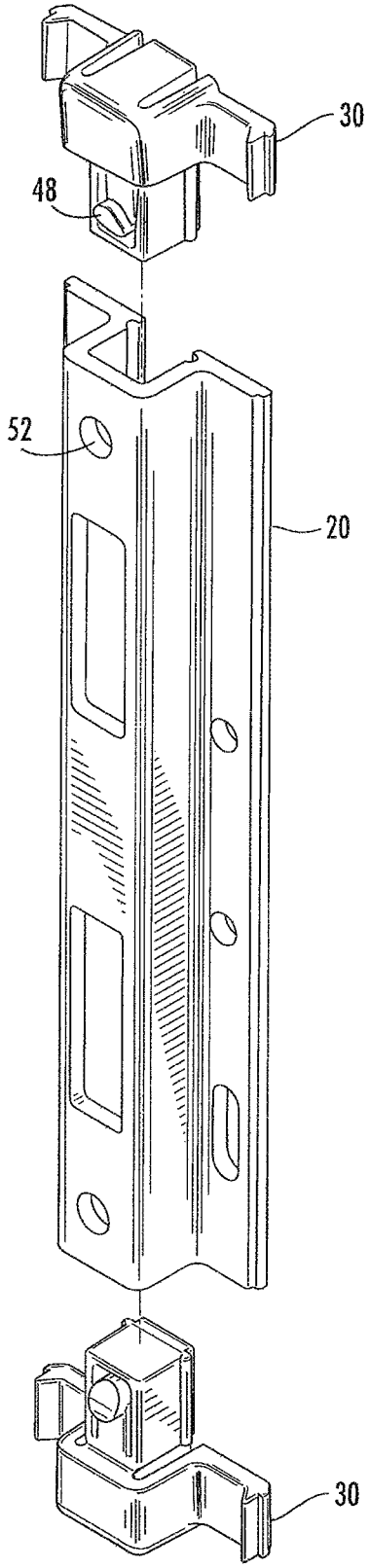
FIG. 10 depicts a perspective view of an assembly of the strike shown in FIG. 3.

For allowing end cap 30 to snap into door frame 64 and, more particularly, hold onto ridge 66, first and second protrusions 36, 40 flex or bend at joints 38, 42 and this flexing or bending is due to notches 39, 43 between each protrusion and center section 32, which allow room for first and second protrusions 36, 40 to flex away from ridge 66 and then, because of the resilient material of each protrusion, return to its shape shown in FIGS. 7-9 when lower finger 46 is behind ridge 66.

Figure 6:
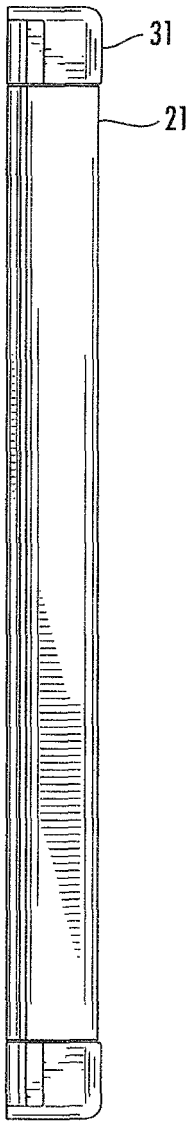
FIG. 6 depicts a side view of the strike shown in FIG. 3.

In some embodiments, top surface 31 of end cap 30 is not flush with or the same as top surface 21 of striker plate 20. As shown in FIG. 6, top surface 31 is higher relative to top surface 21, or where top surface 31 is further away from rear surface 68 of door frame 64 than top surface 21. Because top surface 31 is higher or further away, it inhibits wear to striker plate 20 and therefore preserves an appearance of striker plate 20. In some cases, top surface 31 reduces contact from other door components, such as lock 25 in FIG. 15, because the other door components come in contact with top surface 31 first, which is particularly beneficial when considering repeated door closing and/or locking.

Figure 19:
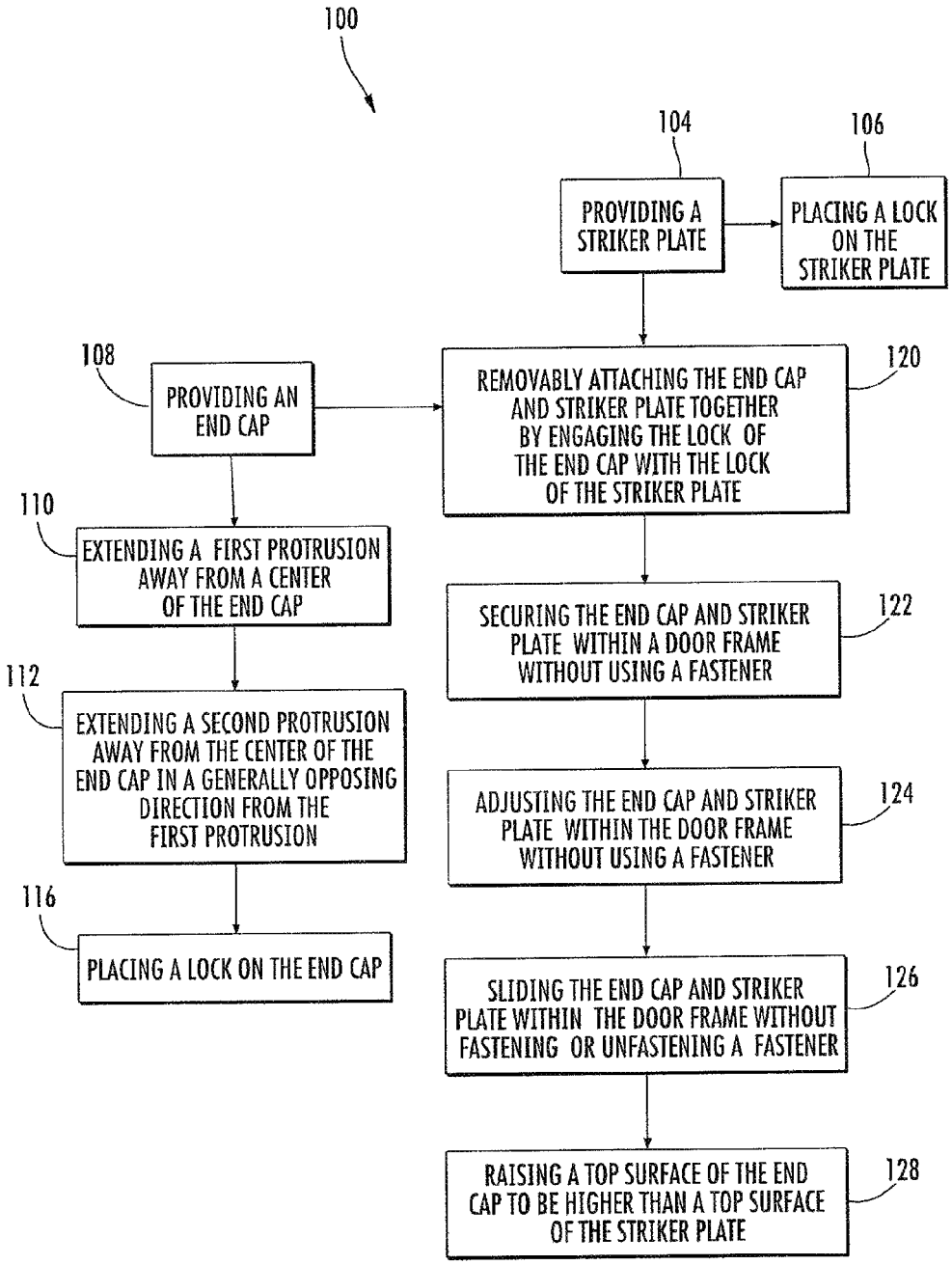
FIG. 19 depicts a method of providing the strike shown in FIG. 3.

FIG. 19 depicts method 100 of providing strike 1, including the steps of providing 104 a striker plate, providing 108 an end cap, extending 110 a first protrusion away from a center of the end cap, and extending 112 a second protrusion away from the center of the end cap in a generally opposing direction from the first protrusion. Method 100 also places 116 a tab on the end cap, places 106 a receiver on the striker plate, and removably attaches the end cap and striker plate together by engaging the tab of the end cap with the receiver of the striker plate.

In some embodiments, method 100 also includes the step of securing 122 the end cap and striker plate within a door frame without using a fastener. In some embodiments, method 100 adjusts 124 the end cap and striker plate within the door frame without using a fastener. In other embodiments, method 100 slides 126 the end cap and striker plate within the door frame without fastening or unfastening a fastener.

In another embodiment, method 100 includes the step of raising 128 a top surface of the end cap to be higher than a top surface of the striker plate, resulting in the end cap being closer than the striker plate to the lock, door, and other components that mate with or come in contact with strike 1.

Other modifications within the scope of the present invention will be apparent to those skilled in the art.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A method for providing an adjustable strike, comprising the steps of:

providing a striker plate having a longitudinal axis and a receiver;

providing an end cap having protrusions and a tab for removably attaching the end cap to the striker plate;

removably attaching the end cap to the striker plate by moving the end cap in a direction of the longitudinal axis of the striker plate and engaging the tab of the end cap with the receiver of said striker plate; and securing the end cap to a door frame via the end cap protrusions.

2. The method according to claim 1 wherein the end cap and striker plate are secured to the door frame without use of a fastener.

3. The method according to claim 2 further comprising the step of adjusting the end cap and striker plate within the door frame without using a fastener.

4. The method according to claim 2 further comprising the step of sliding the end cap and striker plate within the door frame without fastening or unfastening a fastener.

5. The method according to claim 1 further comprising the step of raising a top surface of the end cap to be higher than a top surface of the striker plate.

6. The method according to claim 1 wherein the end cap protrusions comprise a first protrusion that extends away from a center of the end cap and a second protrusion that extends away from the center of the end cap in a generally opposing direction from the first protrusion.

7. The method according to claim 1 wherein the receiver of the striker plate comprises an opening for engaging with the tab of the end cap.

8. The method according to claim 1 wherein the end cap protrusions comprise a resilient material for flexing into the door frame and providing an interference fit.

9. The method according to claim 8 further including at least one of said protrusions of the end cap flexing toward a center of the end cap as said end cap engages with the door frame.

10. The method according to claim 1 wherein the striker plate and end cap are adjustable with respect to the door frame, and further including the step of adjusting the striker plate and end cap to the door frame.

11. The method according to claim 10 wherein the end cap has at least one finger located at an end of each of said protrusions for engaging with the door frame and sliding with respect to the door frame in the direction of the longitudinal axis of said striker plate for adjusting the striker plate to the door frame.

12. The method according to claim 1 further including reducing contact of other door components with the striker plate by the end cap and the striker plate each having a top surface, and wherein the top surface of the end cap is higher along the longitudinal axis relative to the top surface of the striker plate.

13. A method for providing an adjustable strike, comprising the steps of:

providing a striker plate having opposing first and second ends each having a receiver;

providing a first end cap having a first tab and a pair of protrusions;

attaching said first end cap to the first end of the striker plate by the first end cap tab being attached to the receiver at said first end of the striker plate;

providing a second end cap having second first tab and an other pair of protrusions;

attaching said second end cap to the second end of the striker plate by the second end cap tab being attached to the receiver at said second end of the striker plate;

securing the striker plate and first and second end caps to a door frame via the pair of protrusions of the first end cap and the other pair of protrusions of the second end cap; and adjusting the striker plate to the door frame.

14. The method according to claim 13 wherein the first and second end caps and the striker plate are all secured to the door frame without use of a fastener, and further including the step adjusting the end caps and striker plate to the door frame without the use of fasteners.

15. The method according to claim 13 wherein the receivers of the striker plate comprises first and second openings for engaging with the tabs of the first and second end caps.

16. The method according to claim 13 wherein the protrusions of the first and second end caps comprise a resilient material for flexing into the door frame and providing an interference fit.

17. The method according to claim 13 further including at least one of said protrusions of each of said first and second end caps flexing toward a center of the respective end cap as each said end cap engages with the door frame.

18. The method according to claim 13 further including reducing contact of other door components with the striker plate by the end caps and the striker plate each having a top surface, and wherein the top surface of the end caps are higher along a longitudinal axis relative to the top surface of the striker plate.

19. The method according to claim 13 further including providing a means for adjusting the striker plate to the door frame.

20. The method according to claim 19 wherein said means for adjusting said striker plate to said door frame comprises at least one finger located at an end of each of said protrusions of the first and second end caps for engaging with the door frame and sliding with respect to the door frame in the direction of a longitudinal axis of said striker plate.

* * * * *